US005301906A

United States Patent [19]

Bodnar, II

[11] Patent Number: 5,301,906

[45] Date of Patent: Apr. 12, 1994

[54] RAILROAD INTERLOCKING CONTROL SYSTEM HAVING SHARED CONTROL OF BOTTLENECK AREAS

[75] Inventor: Stephen A. Bodnar, II, Pittsburgh, Pa.

[73] Assignee: Union Switch & Signal Inc., Pittsburgh, Pa.

[21] Appl. No.: 900,150

[22] Filed: Jun. 17, 1992

[51] Int. Cl.[5] ..... B61L 17/00; B61L 27/00

[52] U.S. Cl. ..... 246/3; 246/134

[58] Field of Search ..... 246/2 R, 2 E, 2 S, 2 F, 246/3, 4, 5, 131, 132, 133, 134, 162, 28 F, 34 R

[56] References Cited

U.S. PATENT DOCUMENTS

| | | | |
|---|---|---|---|
| 2,793,287 | 5/1957 | Phelps | 246/134 |
| 2,863,992 | 12/1958 | George et al. | 246/134 X |
| 2,910,578 | 10/1959 | Karlet et al. | 246/2 R |
| 3,219,815 | 11/1965 | Livingston | 246/3 |
| 3,307,031 | 2/1967 | Frielinghaus et al. | 246/134 X |
| 3,836,768 | 9/1974 | Clarke et al. | 246/5 X |
| 3,963,203 | 6/1976 | Pascoe | 246/134 |
| 4,066,228 | 1/1978 | Elder | 246/5 |
| 4,181,278 | 1/1980 | Pascoe | 246/134 X |
| 4,610,206 | 9/1986 | Kubala et al. | 246/2 R X |
| 4,641,243 | 2/1987 | Hartkopf et al. | 246/131 X |

FOREIGN PATENT DOCUMENTS

| | | | |
|---|---|---|---|
| 766934 | 9/1980 | U.S.S.R. | 246/2 E |

OTHER PUBLICATIONS

Union Switch & Signal, Inc. Bulletin 401, "Genisys: Microprocessor-Based Programmable Control System" dated Jun. 1989.

Union Switch & Signal, Inc., *RSE Catalog*, sections RSE-11C1 and RSE-11E1, dated Jun. 1988.

Union Switch & Signal, Inc., Bulletin 430, "New Product News: Microlok Plus Vital & Non-Vital Control Package".

*Primary Examiner*—Frank E. Werner
*Assistant Examiner*—Scott L. Lowe
*Attorney, Agent, or Firm*—Buchanan Ingersoll

[57] ABSTRACT

A railroad interlocking control system utilizing a plurality of programmable controllers to regulate flow of train traffic through an interlocking track layout in which a number of track routes converge and overlap into a bottleneck area. Control of switch and signal devices in the bottleneck area is shared by multiple programmable controllers which may reduce redundancy requirements of prior art arrangements.

15 Claims, 6 Drawing Sheets

RAILROAD INTERLOCKING CONTROL SYSTEM HAVING SHARED CONTROL OF BOTTLENECK AREAS

BACKGROUND OF THE INVENTION

1. Field of the Invention:

The present invention generally relates to railroad interlocking controls for regulating flow of traffic through an interlocking track layout. More particularly, the invention relates to such a control utilizing a plurality of programmable controllers arranged to share operative control of switch and signal devices in a bottleneck area.

2. Description of the Prior Art:

In a track layout having a number of switch turnouts and rail crossings, it is necessary to assure a clear route for an entering train in order to fully exploit the train's speed capabilities. The concept of railroad interlocking, developed as early as 1857, provides this clear route assurance by preventing other vehicles from taking routes conflicting with that of the entering train.

One common interlocking system is referred to as route interlocking. In this system, a dispatcher or other operator chooses a route by pushing respective entrance and exit buttons on a control console having a diagram of the track layout. The interlocking control system then automatically locates the most efficient route between the selected entrance and exit points. The system further sets up all track switches along the route and clears an entrance signal. Typically, the wayside signals through the route indicate to the train engineer the allowed maximum speed in a particular track section. An additional feature, known as sectional route locking, releases sections of the route after the train has passed so that other routes may be set up. A typical prior art route interlocking system incorporating many of the above features is fully described and shown in U.S. Pat. No. 4,066,288, issued to J. Calvin Elder on Jan. 3, 1978. This patent is incorporated herein by reference.

Original interlocking systems were completely mechanical. Eventually, however, these mechanical systems were replaced by electrical systems utilizing vital relays to control electrically actuated switch and signal devices. In order to decrease both switching time and cost, recent advances in technology had made it desirable to replace these vital relays with electronic circuits. The first electronic systems used discrete solid state components. Eventually, however, discrete components were replaced by integrated circuits. For greatest flexibility, the most modern controllers are microprocessor-based and can be programmed using software or firmware for use with virtually any interlocking arrangement. Controllers of this type have been marketed by Union Switch and Signal, Inc of Pittsburgh, Pa. under the trademarks MICROLOCK and GENISYS.

In normal operation where multiple programmable controllers are used to control large interlockings, they are typically either linked serially or the interlocking is split up so that particular units handle specific functions. If any one of the units fail, information to move traffic through a bottleneck could be inhibited. In this situation, redundancy has been important. Normally, each unit is changed to a normal/standby configuration which can become costly. Also, the fail-over logic may be cumbersome.

SUMMARY OF THE INVENTION

Railroad interlocking controls practicing the present invention utilize a plurality of programmable controllers to regulate flow of traffic through an interlocking track layout having a number of potential track routes converging and overlapping in a hierarchal arrangement into a bottleneck area. A desired track route is selectively established between respective opposite boundary limits of the track layout by actuation of associated switch and signal devices along the route. Control of switch and signal devices in the bottleneck area is shared by multiple programmable controllers.

Each of the programmable controllers is typically assigned to individually control a number of switch and signal devices away from the bottleneck area. Each of the controllers is then operatively connected to all other switch and signal devices operably included in routes utilizing the respective uniquely controlled switch and signal devices. Thus, where the potential routes converge and overlap, control is shared. The controllers are also preferably in parallel electrical communication as opposed to the serial interconnection of the prior art, to pass therebetween status information.

In using the system, the dispatcher typically chooses the desired route in a manner similar to the prior art by using a control console or other appropriate interactive means. Selection signals representing respective entrance and exit locations are fed from the console to the programmable controllers. In response, the programmable controllers produce function signals to actuate appropriate switch and signal devices, thus establishing the route.

DETAILED DESCRIPTION OF PRESENTLY PREFERRED EMBODIMENTS

In accordance with the invention, a railroad interlocking control system may be provided in which control of switch and signal devices in a bottleneck area of an interlocking track layout is shared by multiple programmable controllers. This approach generally reduces the need for supplying redundant back-up units which may result in significant cost savings over prior art systems.

Figure 1:
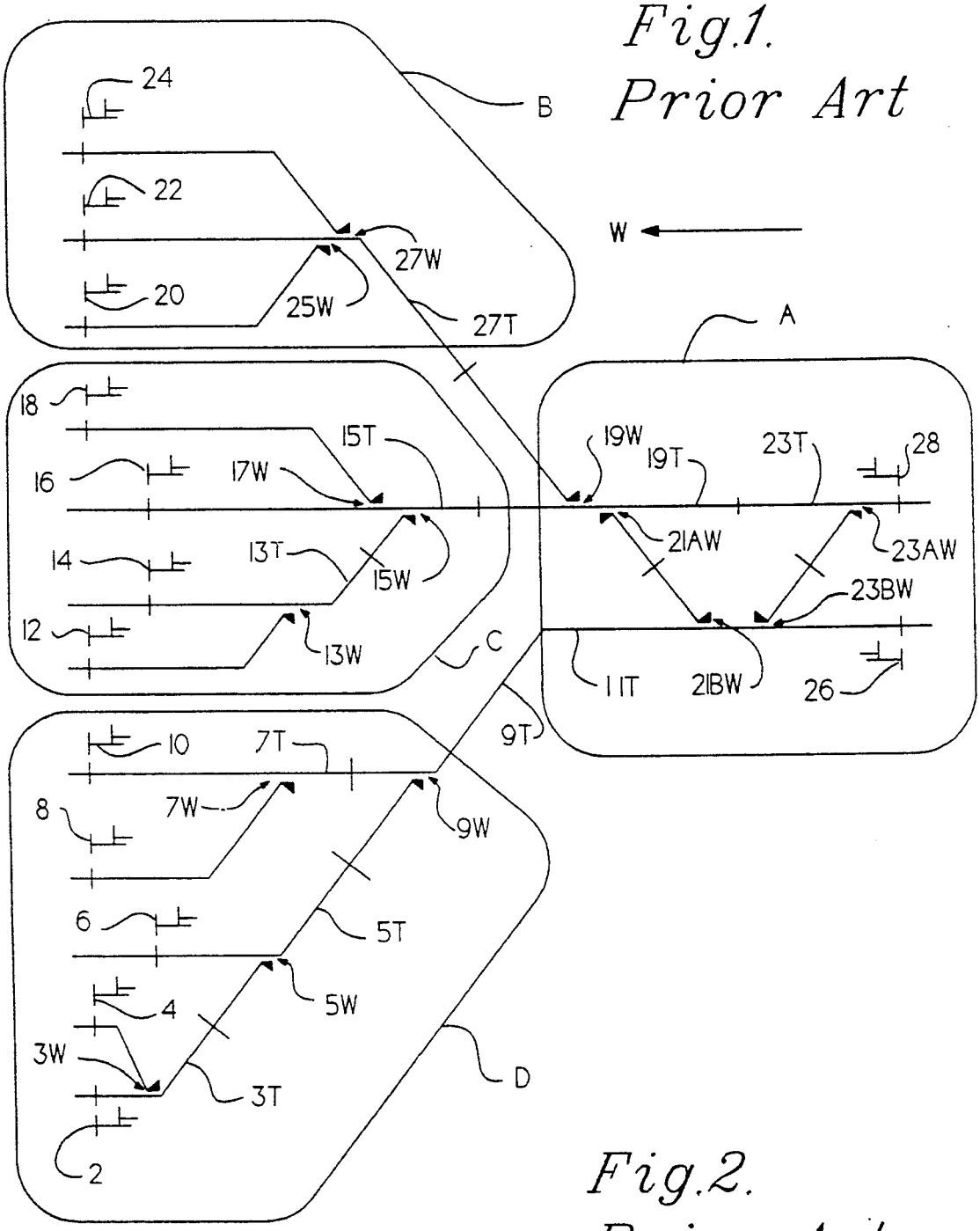
Fig.1. Prior Art
FIG. 1 is a single line diagrammatic representation of an interlocking track layout controlled by multiple programmable controllers A, B, C, D according to the teachings of the prior art.

FIG. 1 illustrates in single line diagrammatic form a typical interlocking track layout controlled by a plurality of programmable controllers A, B, C, D according to the teachings of the prior art. A number of potential track routes traverse the layout and are selectively established by actuation of operably included switch and signal devices. The term "switch and signal devices" is used herein to refer generally to both switch devices and signal devices. Eastbound traffic may enter the track layout at one of the west boundary limits adjacent respective limit signals having even reference numerals 2 to 24. From these west boundary limits, the potential routes converge and overlap in a hierarchal arrangement toward opposite east boundary limits adjacent limit signals 26 and 28.

Within the track layout, the track is typically conventionally divided by insulated joints into track sections. These track sections are referenced by odd numeral prefixes 3 to 27; shown sections have the suffix T. The track switches, which are operated by conventional power switch devices, are also shown having odd number prefixes 3 to 27. Branch switches (where shown) are further designated with the suffix W to the respective track section number. Crossover switches A and B of a particular crossover section, which operate in tandem, are further shown with respective suffixes AW and BW.

Establishment of a selected route through the track layout is typically initiated by a dispatcher respectively choosing an entrance and exit boundary limit. Any branch or crossover switch along the route not already in its requested position will attempt to achieve correspondence. When correspondence is achieved, the route will be locked and the signal adjacent the entrance boundary limit will indicate clearance. Typically, clearance is shown by the signal displaying a green "proceed" aspect. Any intermediate signals present in the route also are automatically set to display an appropriate aspect.

Figure 2:
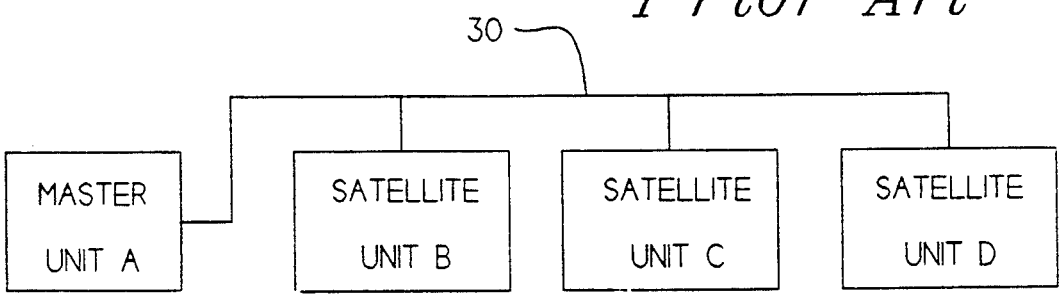
Fig.2. Prior Art
FIG. 2 is diagrammatic representation of the prior art master-satellite arrangement of the programmable controllers shown in FIG. 1.

Programmable controllers A, B, C, D are each assigned to control a specific territory of the track layout. Logic necessary to actuate switch and signal devices within a particular assigned territory is produced exclusively by the respective controller. As shown in FIG. 2, controllers A, B, C, D are traditionally connected in master-satellite arrangement. Controller A is the master unit, and is assigned to the bottleneck, or "critical," territory. Controllers B, C, and D are assigned to respective branch areas. Communication between the controllers is maintained over serial line 30. As an example of a route which may be chosen, movement of a train from the east boundary limit adjacent signal 26 to the west boundary limit adjacent signal 2 will be considered. This requires the following switch positions: 23BW - normal (23BNW), 21BW - normal (21BNW), 9W - reverse (9RW), 5W - reverse (5RW), 3W - reverse (3RW), where the typical nomenclature used in the art to signify these switch positions is shown in parentheses. For this example, unit A controls signal 26 as well as switches 23BW and 21BW. Choice of route information is then passed to unit D on line 30 which sets switches 3W, 5W, and 9W. The failure of unit A in this arrangement will render the whole interlocking track layout unusable until repair can be made. If units B, C or D fail, all tracks in their respective territories are also rendered unusable. It is for this reason that it has been important to provide backup units.

Figure 3:
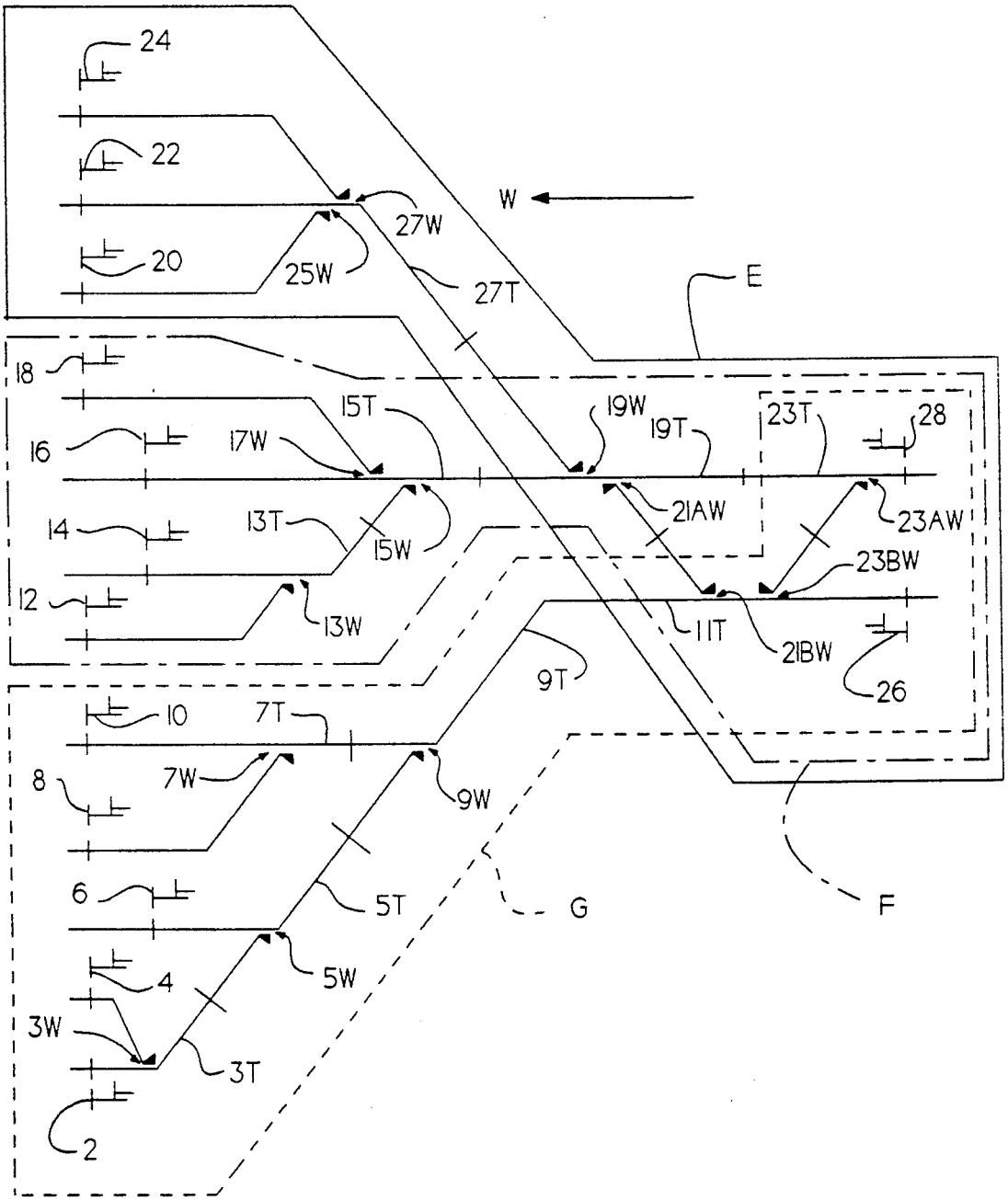
FIG. 3 is a diagrammatic representation of the same track layout shown in FIG. 1 controlled by multiple programmable controllers E, F, G according to the teachings of the present invention.

The present invention may reduce the need for redundancy by utilizing a shared control approach to the set of switch and signal devices in the bottleneck area. Devices in less critical branch territory are uniquely controlled. As shown in FIG. 3, programmable controllers E, F, and G are individually assigned to respective sets of switch and signal devices away from the bottleneck area. The controllers are further each operatively connected to all other switch and signal devices in the hierarchal arrangement which are operably included in routes utilizing the respective individually controlled switch and signal devices. Thus, controller E is uniquely operatively connected to signals 20, 22, 24 and switches 25W, 27W. Controller F is similarly uniquely connected to signals 12, 14, 16, 18 and switches 13W, 15W, 17W. Unit G is likewise individually connected to signals 2, 4, 6, 8, 10 and switches 3W, 5W, 7W, 9W. Switch and signal devices in the bottleneck area are controlled by multiple units. Thus, in normal operation, a particular controller E, F, or G will be able to control devices along an entire route between the east boundary limits and one of its individually assigned west boundary limit signals.

Figure 4:
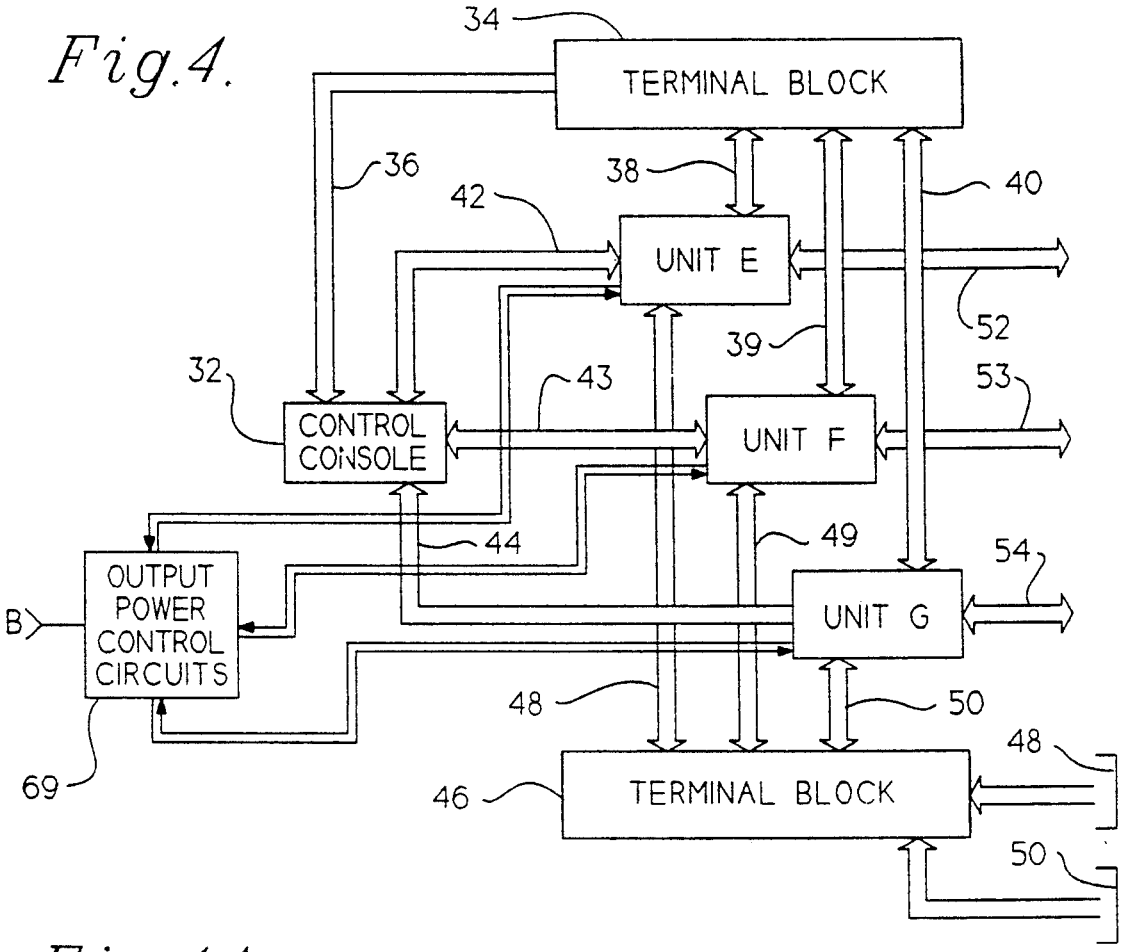
FIG. 4 is a block flow diagram illustrating the electrical interconnection of the programmable controllers of FIG. 3.

The need for redundancy can be further reduced if function signals produced to actuate switch and signal devices in the shared territory are repeated. For example, a signal to move switch 23W to its normal position (23ANW) could be produced in all three controllers E, F, G. Other logic signals could also be repeated in multiple units to prohibit establishment of entrances and exits conflicting with the selected desired route. The darkened areas at the bottom right corners of controllers E, F, G in FIG. 4 are shown to represent repeated logic operations.

From the standpoint of the operator, the system of the present invention is used similarly to prior art route interlocking systems. As shown in FIG. 4, however, the electrical interconnection of the various components is different. Input/output signals regarding entrance and exit locations in the shared territory are transferred between control console 32 and terminal block 34 over data communication link 36. This information is further transferred in parallel fashion between controllers E, F, G and terminal block 34 over respective data communication links 38, 39 and 40. Signals regarding in territories individually controlled by controllers E, F, G are transferred between control console 32 and the respective unit over data communication links 42, 43 and 44.

Signals to and from the field are respectively transferred in parallel fashion between controllers E, F, G and terminal block 46 over data communication links 48, 49 and 50. Function signals to actuate switch and signal devices in the shared territory is output from terminal block 46 on function signal output link 48. Switch position indication signals are received at terminal block 46 from the field at indication input link 50.

Signals to and from the field for track areas individually controlled by units E, F, G are passed over data communication links 52, 53 and 54, respectively.

Figure 4A:
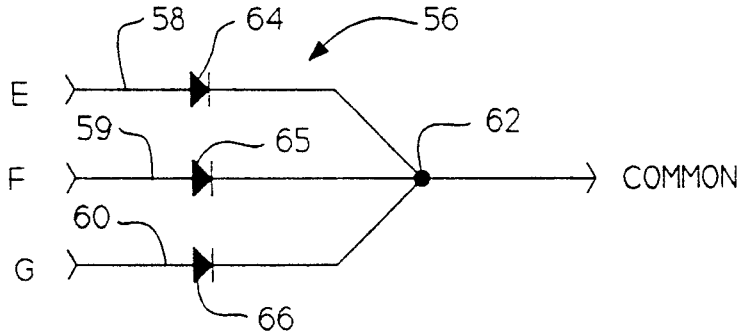
FIG. 4A is a schematic diagram illustrating a typical terminal connection wherein information is passed from the controllers to a common line.
Figure 4B:
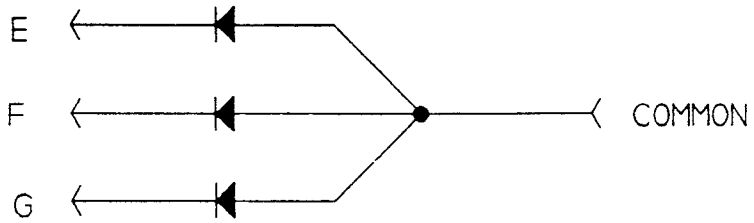
FIG. 4B is a schematic diagram illustrating a typical terminal connection wherein information is passed from a common line to the controllers.

FIG. 4A illustrates a typical terminal 56 connection such as may be used on terminal blocks 34 and 46. Signals output from respective controllers E, F, G are respectively fed via lines 58, 59, 60 to common connection at node 62. Interposing diodes 64, 65, 66 are provided to prevent undesired backfeed. FIG. 4B illustrates a similar terminal connection for outputting a common signal to the three controllers.

Figure 4C:
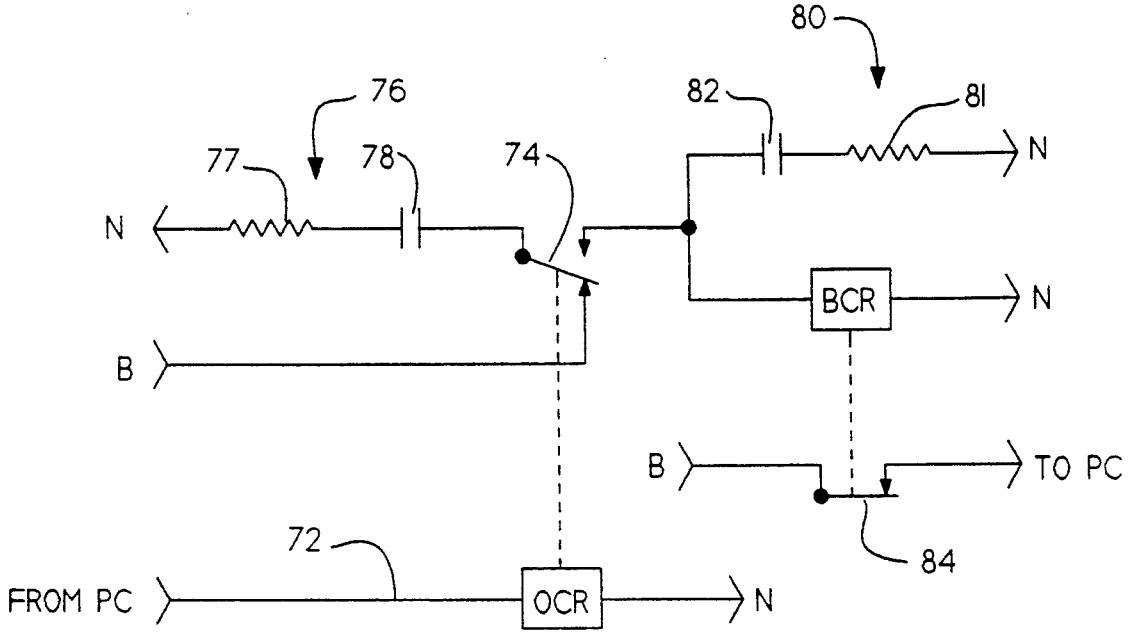
FIG. 4C is a schematic diagram of an output power control circuit provided for each programmable controller to shut the respective controller out of the control system when disabled.

Generally, the output board of programmable controllers E, F, G are of a type referred to as constant delivery printed circuit boards. In other words, output contacts remain in the last position requested. If power to operate logic fails, or the unit itself stops operating, unwanted outputs may be maintained or delivered. Thus, each programmable controller E, F, G has an associated output power control circuit preferably using external relays. These circuits are referred to collectively in FIG. 4 as 69. One such circuit is illustrated particularly in FIG. 4C in which connections to positive and negative terminals of a direct current source are designated by reference characters B and N, respectively.

The programmable controller associated with the control circuit is adapted to provide a special pulse output which is received on line 72. Generally, this may be accomplished with software. The special pulsed output causes intermittent application of energy to the output control relay ("OCR"). As a result, relay armature 74 "chatters" intermittently between its front and back positions. When armature 74 is in its back position, energy is supplied from terminal B to RC network 76. Current will flow through resistor 77 until such time as capacitor 78 is fully charged. When armature 74 is in its normal position, capacitor 78 will discharge through battery control relay ("BCR") and RC network 80 (having resistor 81 and capacitor 82). This flow of current through relay BCR will thus maintain BCR armature 84 in the closed position. Simultaneously, current flow through resistor 81 will tend to charge capacitor 82. When armature 74 falls again to the reverse position, capacitor 82 discharges through relay BCR. Thus, armature 84 is maintained in the closed position during the interim. When closed, armature 84 provides electrical connection between terminal B and the distribution bus for all output contacts except the one that feeds relay OCR. It has been found suitable to use 1000 microfarad capacitors and 100 ohm resistors in RC networks 76 and 80 when pulses of one second in duration are applied on line 72.

Figure 5:
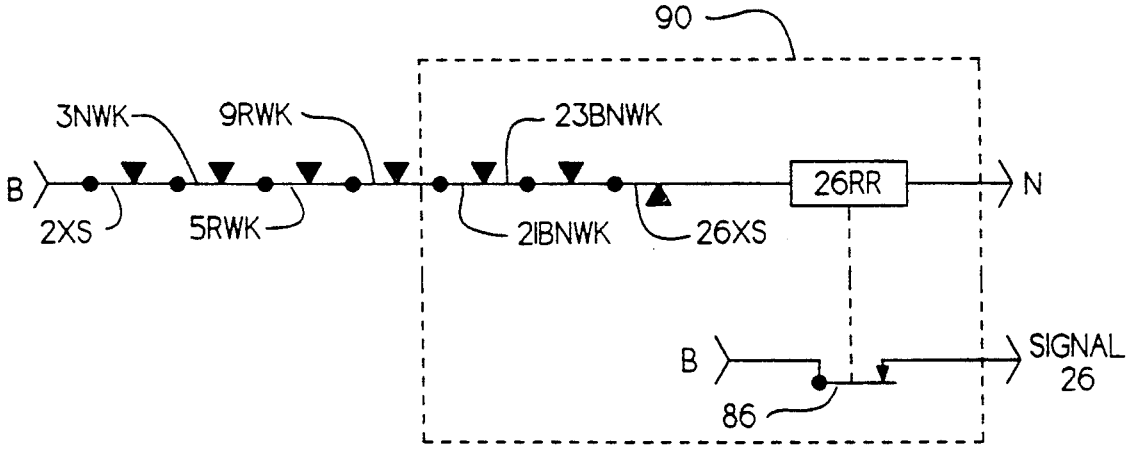
FIG. 5 is a relay logic diagram illustrating operations performed to establish a hypothetical desired track route.

FIG. 5 is a functional diagram representing the establishment of the example route discussed above according to the present invention. The diagram is functional only, since the relay functions shown here are actually performed digitally by the programmable controller units E, F, G. The application of energy from terminal B to relay 26RR causes the associated armature 86 to close. Direct current will thus be fed to signal 26, allowing it to give a "proceed" aspect. In order, however, to provide continuity between terminal B and relay 26RR, a series of interposing relay contacts must be appropriately closed.

First, the 2XS (2 exit stick) relay contact must be closed in its front position. This designates that the boundary limit adjacent signal 2 has been chosen as an exit. Further, switch position indication relays (designated by the switch position plus the suffix K) for all switch positions in the desired route must likewise have their contacts closed in the front position. Thus, contacts 3NWK, 5RWK, 9RWK, 21BNWK and 23BNWK are shown also making contact in the front position. Since entrance is desired at the boundary limit adjacent signal 26, it cannot serve as an exit. As such, relay contact 26XS makes contact in its back position. As discussed above, control of switch and signal devices within the bottleneck area is shared by units E, F, and G. Thus, certain of the functions shown in FIG. 5 are repeated in all units. These repeated logic operations are illustrated as being those within box 90.

In addition to function and indication operations for the shared area, other operations may also be repeated in multiple units. One such operation would be the entrance lockout ("ELO") function. Once an entrance has been selected, ELO prevents the establishment of another entrance until an exit location has also been selected. With the present invention, the selection of an entrance location in territory assigned to a particular controller causes ELO information to be passed parallel to the other controllers. This, in turn, activates the other controllers' own ELO.

Figure 6A:
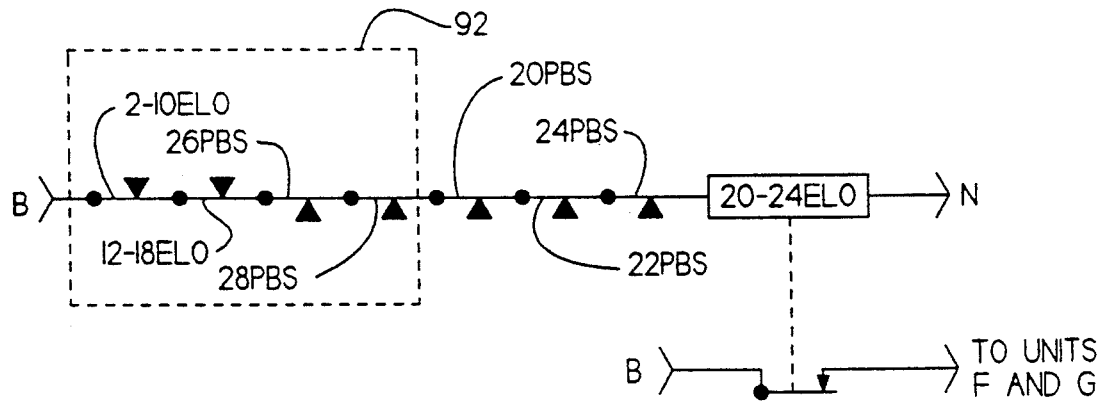
FIGS. 6A, 6B and 6C are relay logic diagrams respectively illustrating entrance lockout ("ELO") operations in programmable controllers E, F and G.
Figure 6B:
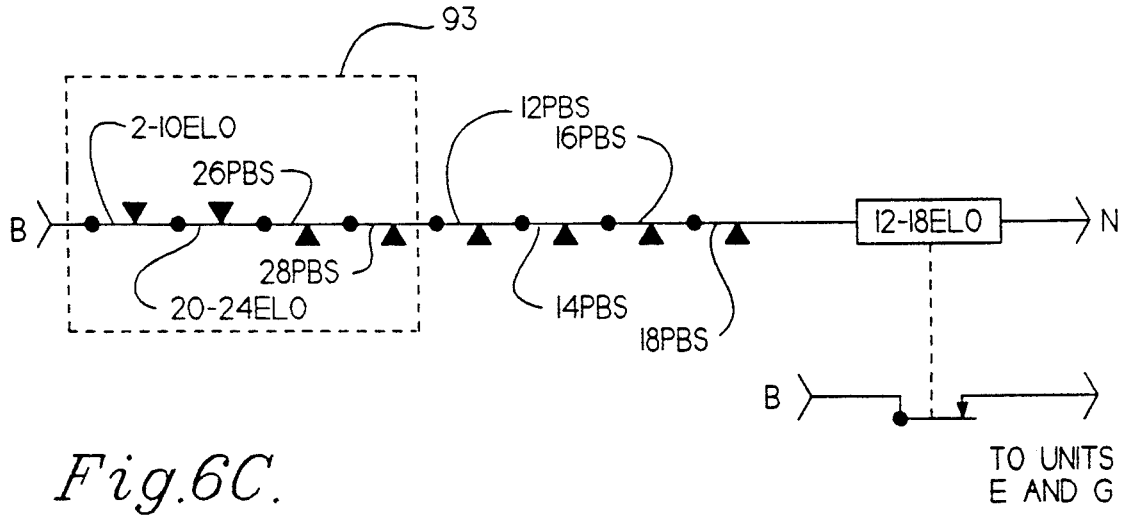
Figure 6C:
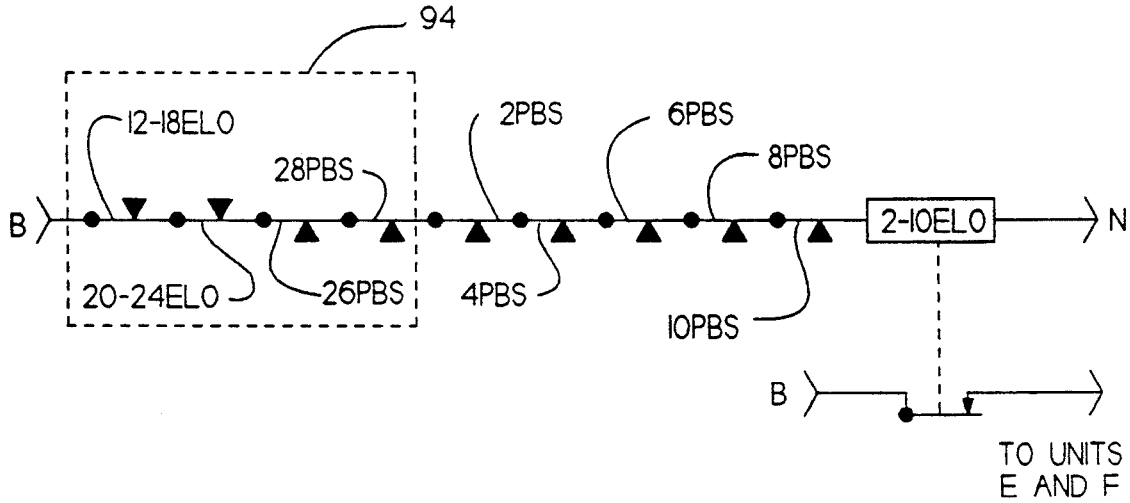

FIGS. 6A, 6B and 6C respectively illustrate ELO operations in controllers E, F, and G. Information repeated in multiple units is shown respectively within boxes 92, 93 and 94. In terminology frequently used in the art, selection of an entrance location is referred to as a push button stick ("PBS"). Since the east boundary limits adjacent signals 26 and 28 are in the bottleneck area controlled by all three units E, F, G, the operations 26PBS and 28PBS are repeated in all three controllers. As an example, assume that an entrance is desired at the west boundary limit adjacent signal 14. This is in the territory exclusively controlled by unit F. As shown in FIG. 6B, the armature labeled 14PBS would open from the back contact. This would cause normally closed relay 12–18 ELO relay to open.

A malfunction of one of units E, F, or G to give a constant "on" output may hamper effective switch control over switches in shared territory. This can be best illustrated with reference to FIG. 4A. For example, an erroneous "on" output from controller E will give a corresponding "on" output at node 62 even if controllers F and G are giving "correct" outputs. In order to minimize the traffic interruption problems this could cause, switch devices controller by multiple programmable controllers are preferably provided with check circuits using external relays. These check circuits allow switch position to be requested by manual operation. Train movement through areas not controlled by the malfunctioning unit can thus be maintained until repair can be made.

Figure 7:
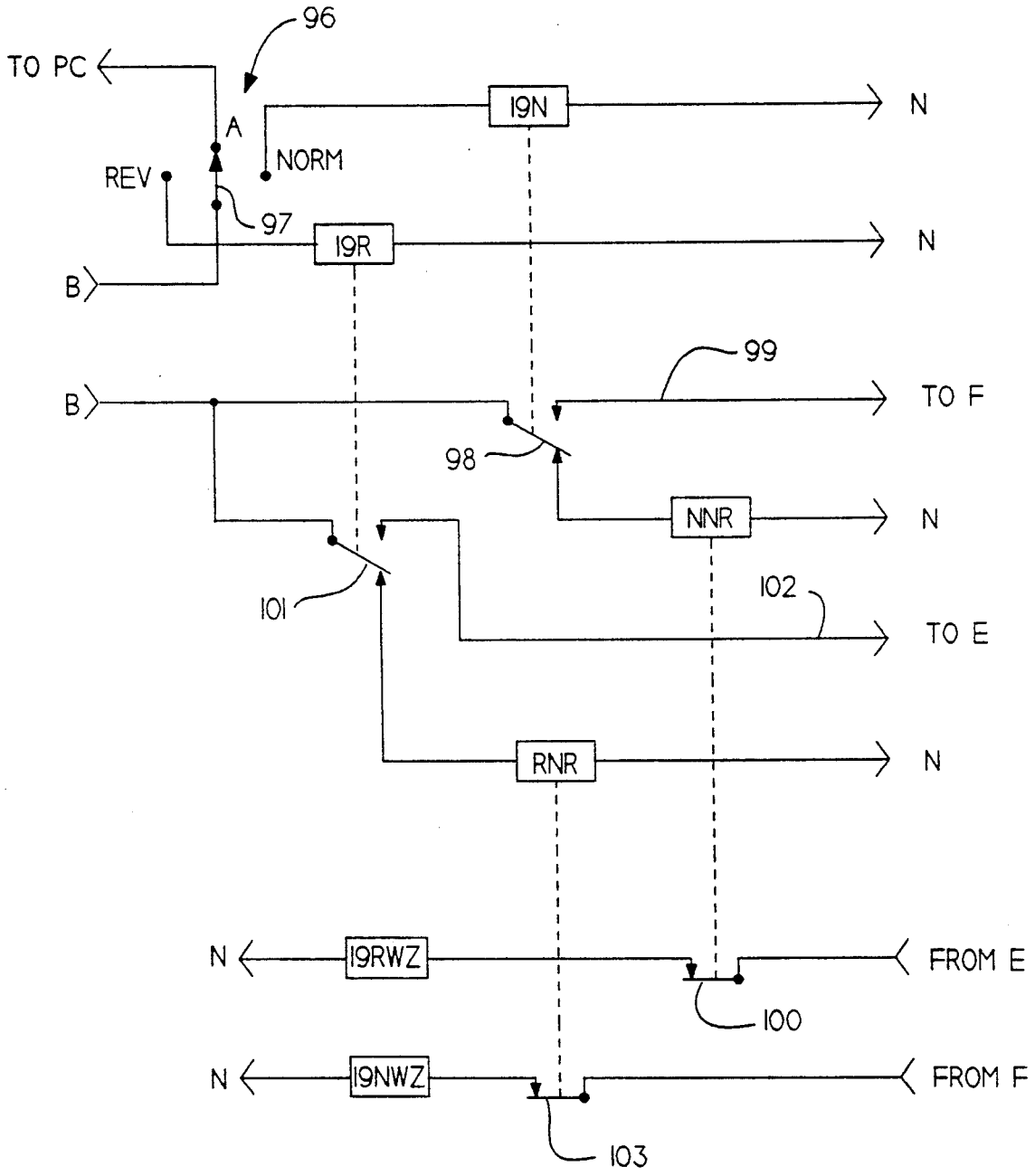
FIG. 7 is a schematic diagram of a check circuit permitting manual request of switch movement in the bottleneck area.

Referring particularly to FIG. 7, a check circuit is illustrated for switch 19W. Three-position selector 96 allows the dispatcher to manually choose between switch positions or simply allow automatic operation. Thus, selector 96, which is typically located on control console 32, is generally left in its automatic position A. If, however, programmable controller E delivers a constant reverse position output (19RW), traffic to branch areas controlled by unit F may be inhibited. In this situation, the operator simply moves armature 97 to position NORM, thus providing electrical continuity between terminal B and relay 19N. Armature 98 of relay 19N will then be picked up into its normal position. As a result, a normal lever repeater ("NLP") signal will be received from line 99 by unit F. The NLP signal is the normal programmable controller input for manual request as that in the prior art. At the same time, relay NNR will be disconnected from terminal B, causing armature 100 to drop open. All electrical communication from unit E to switch machine reverse position relay 19RWZ will thus be interrupted.

Similarly, a malfunction of unit F to give a constant 19NW output may inhibit traffic to branch areas controlled by programmable controller E. Here, the dispatcher may restore traffic flow through this territory by actuating selector 92 into position REV. Electrical continuity is then established between terminal B and relay 19R. As a result, armature 101 of relay 19R is moved into its normal position. A reverse lever repeater ("RLP") output is then sent to unit E on line 102. At the same time, energy normally applied to reverse not requested relay RNR is interrupted, causing armature 103 to open. As such, output from unit F to switch machine normal position relay 19NWZ is suspended. After suitable repair of the malfunctioning unit, the automatic mode of operation is resumed by simply returning armature 93 to position A.

It can thus be seen that the invention provides a railroad interlocking control system, in which control of switch and single devices in bottleneck territory is shared by multiple programmable controllers. As a result, the need for redundant back-up units is reduced and system availability is enhanced. While those certain preferred embodiments have been described and shown herein, it is to be understood that various other embodiments and modifications can be made within the scope of the following claims.

I claim:

1. A railroad interlocking control for use in regulating a flow of railway traffic through an interlocking track layout having a multiplicity of switch and signal devices which are operated to provide a plurality of track routes converging and overlapping in a hierarchal arrangement, said control comprising:

interactive means for outputting selection signals representative of first and second boundary limits respectively serving as an entrance and exit of a selected one of said track routes;

a plurality of programmable controllers responsive to said selection signals and operable to produce function signals for actuating said switch and signal devices operably included in said selected one of said track routes;

each of said programmable controllers uniquely operatively connected to respective first sets of said switch and signal devices, each of said first sets including said switch and signal devices operably included in routes not operably including said switch and signal devices in other of said first sets;

each of said programmable controllers further operatively connected with other of said programmable controllers in a shared control arrangement to said switch and signal devices in a second set of said switch and signal device;

said second set including those of said switch and signal devices which are respectively operably included in a plurality of said track routes which operably include said switch and signal devices in at least two of said first sets; and each of said programmable controllers further being electrical communication with other of said plurality of programmable controllers to transfer therebetween status information.

2. The railroad interlocking control of claim 1 wherein function signals to actuate said switch and signal devices in said second set are repeated by at least two of said plurality of programmable controllers.

3. The railroad interlocking control of claim 2 wherein said status information includes entrance lockout data.

4. The railroad interlocking control of claim 2 wherein entrance push button stick operations for boundary limits adjacent any of said switch and signal devices in said second set are repeated in at least two of said plurality of programmable controllers.

5. The railroad interlocking control of claim 2 wherein exit push button stick operations for boundary limits adjacent any of said switch and signal devices in said second set are repeated in at least two of said plurality of programmable controllers.

6. The railroad interlocking control of claim 2 wherein function signals repeated by at least two of said plurality of programmable controllers are output to terminal connections having respective input lines coming together to a common node.

7. The railroad interlocking control of claim 6 wherein interposing diodes are electrically connected on said respective input lines between said at least two of said plurality of programmable controllers and said common node.

8. The railroad interlocking control of claim 1 wherein said status information is transferred between said plurality of programmable controllers in parallel fashion.

9. The railroad interlocking control of claim 1 wherein said status information comprises position indication signals for said switch and signal devices controlled by at least two programmable controllers and said indication signals are received by all of said at least two programmable controllers.

10. The railroad interlocking control of claim 9 wherein said position indication signals for said switch and signal devices controlled by at least two programmable controllers are received at a common node of a terminal connection from which separate output lines are electrically connected to respective of said at least two programmable controllers.

11. The railroad interlocking control of claim 10 wherein respective interposing diodes are electrically connected on said separate output lines intermediate said common node and said at least two programmable controllers.

12. The railroad interlocking control of claim 1 further comprising an output power control circuit for each of said plurality of programmable controllers to interrupt a source of output power to output logic of an associated programmable controller should said associated programmable controller stop operating.

13. The railroad interlocking control of claim 12 wherein each said output power control circuit is external of said associated programmable controller and comprises the combination of:

a first relay receiving as an input a pulse signal from said associated programmable controller, an armature of said first relay moving intermittently between a first and a second contact in response to said pulse signal;

a first RC network having a first capacitor and a first resistor electrically connected to said armature of said first relay;

a source of DC energy in electrical connection with said second contact such that movement of said armature to said second contact causes charging of said first capacitor;

a second relay electrically connected to said first contact; and a second RC network having a second capacitor and a second resistor, said second RC network electrically connected to said first contact in parallel with said second relay, said second capacitor maintaining said armature of said second relay in a closed position when said armature of said first relay is not in connection with said first contact.

14. The railroad interlocking control of claim 1 further comprising check circuits for respective switch devices controlled by at least two of said programmable controllers to position said respective switch device if one of said at least two programmable controllers gives an erroneous constant switch position command.

15. The railroad interlocking control of claim 14 wherein each said check circuit comprises the combination of:

selector means for choosing operation of said switch device in either an automatic or manual mode, said selector means operable in said manual mode for requesting said associated switch device in either a normal or reverse position;

a normal position relay responsive to said selector means upon a request for said normal position to move an associated normal position relay armature from a first back contact to a first front contact, said normal position relay armature electrically connected to a source of DC energy;

said first back contact electrically connected to a normal-not-requested relay;

said first front contact in electrical communication with at least one of said at least two programmable controllers;

a reverse position relay responsive to said selector means upon a request for said reverse position to move an associated reverse position relay armature from a second back contact to a second front contact, said reverse position relay armature electrically connected to said source of DC energy;

said second back contact electrically connected to a reverse-not-requested relay; and said second front contact in electrical communication with at least one of said at least two programmable controllers.

* * * * *